US008593300B2

(12) United States Patent
Ooshima et al.

(10) Patent No.: US 8,593,300 B2
(45) Date of Patent: Nov. 26, 2013

(54) VEHICLE APPROACH WARNING SYSTEM, PORTABLE WARNING TERMINAL AND IN-VEHICLE COMMUNICATION APPARATUS

(75) Inventors: Hiromitsu Ooshima, Kariya (JP); Satoshi Nakamura, Kariya (JP)

(73) Assignee: Denso Corporation, Kariya (JP)

( * ) Notice: Subject to any disclaimer, the term of this patent is extended or adjusted under 35 U.S.C. 154(b) by 427 days.

(21) Appl. No.: 12/927,742

(22) Filed: Nov. 22, 2010

(65) Prior Publication Data

US 2011/0133954 A1 Jun. 9, 2011

(30) Foreign Application Priority Data

Dec. 3, 2009 (JP) ..... 2009-275398
Jul. 30, 2010 (JP) ..... 2010-171885

(51) Int. Cl.
*G08G 1/00* (2006.01)

(52) U.S. Cl.
USPC ..... 340/901; 340/902; 340/903; 340/904; 340/905; 340/933; 340/435; 340/436; 701/300; 701/301

(58) Field of Classification Search
USPC ..... 340/901–905, 933, 936, 435, 436; 701/300, 301
See application file for complete search history.

(56) References Cited

U.S. PATENT DOCUMENTS

| | | | | |
|---|---|---|---|---|
| 7,095,336 | B2 * | 8/2006 | Rodgers et al. | 340/903 |
| 7,451,046 | B2 * | 11/2008 | Nath et al. | 701/301 |
| 8,253,589 | B2 * | 8/2012 | Grimm et al. | 340/901 |

FOREIGN PATENT DOCUMENTS

| | | |
|---|---|---|
| JP | 2000-331290 | 11/2000 |
| JP | 2002-74593 | 3/2002 |
| JP | 2002-352395 | 12/2002 |
| JP | 2006-331154 | 12/2006 |
| JP | 2007-72860 | 3/2007 |
| JP | 2007-182195 | 7/2007 |
| JP | 2007-257302 | 10/2007 |
| JP | 2009-15587 | 1/2009 |

OTHER PUBLICATIONS

Office Action dated Aug. 3, 2012 and Search Report issued in corresponding Chinese Application No. 2010-10576538.9 with English translation.
Office action dated Nov. 01, 2011 in corresponding Japanese Application No. 2010-171885.
Office action dated Mar. 13, 2013 in corresponding Chinese Application No. 2010 10576538.9.

* cited by examiner

*Primary Examiner* — Tai T Nguyen
(74) *Attorney, Agent, or Firm* — Harness, Dickey & Pierce, PLC

(57) ABSTRACT

A vehicle approach warning system is disclosed. The vehicle approach warning system includes: an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to give, in response to receiving the vehicle travel data wirelessly transmitted from the in-vehicle communication apparatus, a warning about approach of the vehicle to the pedestrian in a way other than auditory stimulation if electric field strength at a time of receiving the vehicle travel data is larger than a threshold.

20 Claims, 6 Drawing Sheets

VEHICLE APPROACH WARNING SYSTEM, PORTABLE WARNING TERMINAL AND IN-VEHICLE COMMUNICATION APPARATUS

CROSS REFERENCE TO RELATED APPLICATION

The present application is based on Japanese Patent Application No. 2009-275398 field on Dec. 3, 2009 and Japanese Patent Application No. 2010-171885 field on Jul. 30, 2010, disclosures of which are incorporated herein by reference.

BACKGROUND OF THE INVENTION

1. Field of the Invention

The present invention relates to a vehicle approach warning system, a portable warning terminal, and an in-vehicle communication apparatus.

2. Description of Related Art

Japanese Unexamined Patent Application Publication No. 2007-182195 discloses an alarm system that enables a hearing-impaired person to notice the presence of an alarm horn sound when a vehicle emits the alarm horn sound. Specifically, when the vehicle emits the alarm horn sound, an in-vehicle communication apparatus transmits a warning radio wave to the surroundings. When a portable warning terminal carried by the hearing-impaired person receives this warning radio wave, the portable warning terminal vibrates a vibrator or emits warning-colored light.

The inventors of the present application have found out the followings. A situation requiring a person to be warned is not limited to only a time when a vehicle sounds an alarm horn. For example, when a vehicle approaches a person from his or her back, the person may not notice the approach of the vehicle if the person is hearing-impaired or if the traveling sound of the vehicle is small. In this situation, a driver of the vehicle possibly assumes that the person is noticing the traveling sound of the vehicle and is walking with care. The driver may not sound an alarm horn.

SUMMARY OF THE INVENTION

In view of the foregoing, it is a first objective of the present invention to provide a technique that makes it possible to warn a person about approach of a vehicle in a way other than auditory stimulation when the vehicle approaches the person. It is a second objective of the present invention to provide a technique that makes it possible to inform a driver of a vehicle that a pedestrian carrying a portable warring terminal exists at a short distance from the vehicle.

According to a first aspect of the present invention, a vehicle approach warning system is provided. The vehicle approach warning system includes an in-vehicle communication apparatus mounted to a vehicle and a portable warning terminal carried by a pedestrian. The in-vehicle communication apparatus wirelessly transmits vehicle travel data to surroundings of the vehicle. In response to receiving the vehicle travel data wirelessly transmitted from the in-vehicle communication apparatus, the portable warning terminal warns the pedestrian about approach of the vehicle in a way other than auditory stimulation if electric field strength at a time of receiving the vehicle travel data is larger than a first threshold.

According the above vehicle approach warning system, it is possible to warn a person about approach of a vehicle in a way other than auditory stimulation when the vehicle approaches the person.

According to a second aspect of the present invention, a portable warning terminal o be carried by a pedestrian is provided. The portable warning terminal includes a determination section and a pedestrian side warning section. In response to receiving a vehicle travel data wirelessly transmitted from an in-vehicle communication apparatus of a vehicle, the determination section determines whether electric field strength at a time of receiving the vehicle travel data is larger than a threshold. The pedestrian side warning section warns the pedestrian about approach of the vehicle in a way other than auditory stimulation when the determination section determines that the electric field strength at the time of receiving the vehicle travel data is larger than the threshold.

According the above vehicle portable warning terminal, it is possible to warn a person about approach of a vehicle in a way other than auditory stimulation when the vehicle approaches the person.

According to a third aspect of the present invention, an in-vehicle communication apparatus to be mounted to a vehicle is provided. The in-vehicle communication apparatus includes a transmission section and a vehicle side warning section. The transmission section wirelessly transmits vehicle travel data to surroundings of the vehicle. The vehicle side warning section receives a reply from a portable warning terminal carried by a pedestrian and gives a warning notification to a drive of the vehicle if the portable warning terminal receives the vehicle travel data wirelessly transmitted from the transmission section and sends the reply to the in-vehicle communication apparatus.

According to the above in-vehicle communication apparatus, it is pbssible to inform a driver of a vehicle that a pedestrian carrying a portable warring terminal exists at a short distance from the vehicle.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF EMBODIMENTS

First Embodiment

A first embodiment of the present invention will be described below.

Figure 1:
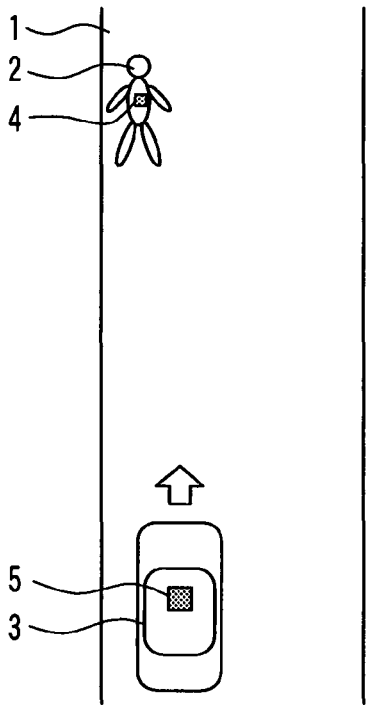
FIG. 1 is a diagram illustrating a configuration of a vehicle approach warning system according to embodiments of the present invention.

FIG. 1 is a diagram illustrating a vehicle approach warning system according to the present embodiment. As shown in FIG. 1, a pedestrian 2 walks on a road 1 and a vehicle 3 approaches the pedestrian 2 from his or her back. In this case, if the vehicle traveling sound is sufficiently large and the pedestrian 2 has an average hearing-ability, the pedestrian 2 can hear the vehicle traveling sound and notices the approach of the vehicle 3. In the above, the vehicle 3 may be a hybrid vehicle, an electric vehicle, or other automobile. The vehicle traveling sound is a sound generated by a vehicle that is normally traveling. For example, the vehicle traveling sound may be an engine noise.

However, a person with hearing-difficulties, a hearing-impaired elder and the like may not notice the approach of the vehicle 3. In addition, since vehicles with remarkably small traveling sounds are becoming widely used, it is expected that, in many cases, even a person having an average hearing-ability cannot notice the approach of the vehicle from his or her back via sounds. In the above, the vehicles with remarkably small traveling sounds are, for example, a hybrid vehicle, an electric vehicle and the like.

As measures against cases of inability of the pedestrian 2 to detect the approach of the vehicle 3 from his or her back, the vehicle approach warning system of the present embodiment includes a portable warning terminal 4 carried by a pedestrian 2 and a navigation apparatus 5 mounted to a vehicle 3. The navigation apparatus 5 transmits a wireless signal to the surroundings and the portable warning terminal 4 receives the wireless signal, and the portable warning terminal 4 detects the approach of the vehicle 3 and vibrates. The navigation apparatus 5 can act as an in-vehicle communication apparatus.

Figure 2:
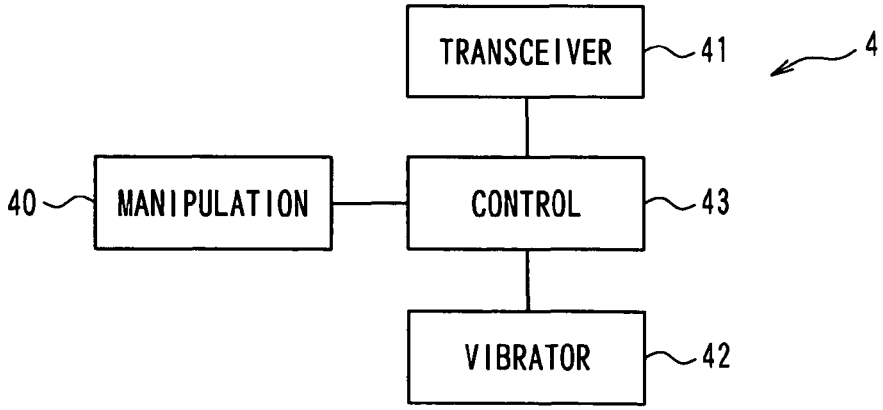
FIG. 2 is a diagram illustrating a configuration of a portable warning terminal.

FIG. 2 is a diagram illustrating the portable warning terminal 4. The portable warning terminal 4 includes a manipulation portion 40, a transceiver 41, a vibrator 42 and a controller 43 (i.e., control device 43). The manipulation portion 40 directly accepts an input from the pedestrian 2 via receiving his or her manipulation and outputs a signal indicative of contents of the received manipulation to the controller 43. For example, the manipulation portion 40 includes a pressing-type button.

The transceiver 41 is a wireless communication device that performs known operations such as amplification, frequency conversion, modulation, demodulation and the like to transmit and receive a wireless signal by a predetermined communication method. The predetermined communication method is, for example, a method using frequency modulation (FM), which is robust against noise. The transceiver 41 operates under control of the controller 43. The transceiver 41 includes a circuit etc. for detecting electric field strength of a received signal. The circuit is for example an RSSI circuit (received signal strength indicator circuit). A result of detection by the circuit is outputted as an electric field strength signal. The transceiver 41 outputs the electric field strength signal to the controller 43. In the following, it is assumed that the portable warning terminal 4 uses the transceiver 41 when the controller 43 communicates with the navigation apparatus 5.

The vibrator 42 vibrates to give vibrotactile stimulation to the pedestrian 2 who is carrying the portable warning terminal 4. Vibration strength and vibration frequency of the vibrator 42 are controllable by the controller 43.

The controller 43 includes a microcomputer having a CPU (central processing unit), a RAM (random access memory), a ROM (read-only memory), a flash memory; and an I/O (input/output), a timer and the like. The CPU executes a program in the ROM to perform a desired processing. In processing, the controller 43 acquires a signal from the manipulation portion 40 and controls the transceiver 41 and the vibrator 42 on an as-needed basis. The controller 43 can perform on/off control of supply of electric power from a power supply (not shown) to the vibrator 42. Processes of the controller 43 will be described in detail later.

Figure 3:
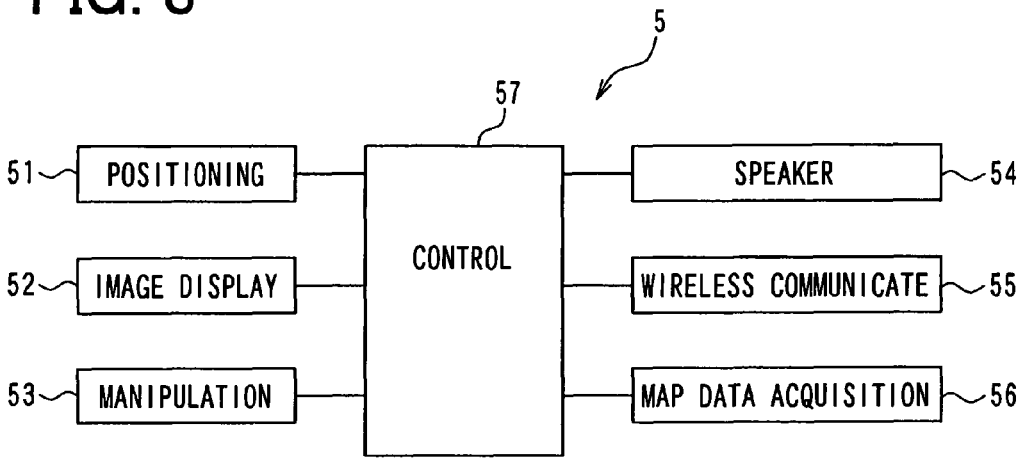
FIG. 3 is a diagram illustrating a configuration of a navigation apparatus.

FIG. 3 is a diagram illustrating a hardware configuration of the navigation apparatus 5. The navigation apparatus 5 is mounted to a vehicle. The navigation apparatus 5 includes a position detection device 51, an image display device 52, a manipulation portion 53, a speaker 54, a wireless communication device 55, a map data acquisition device 56, and a control circuit 57 (i.e., controller 57).

The position detection device 51 includes known sensors (not shown) such as an acceleration sensor, a geomagnetic sensor, a gyro sensor, a vehicle speed sensor, a GPS receiver and the like. To the control circuit 57, the position detection device 51 outputs a signal containing information for finding out a present position, an orientation, and a speed of the vehicle based on characteristics of the foregoing sensors.

The image display device 52 displays an image to a driver of the vehicle based on an image signal outputted from the control circuit 57. The displayed image is for example a map, which may show a present location of the subject vehicle at the center of the map.

The manipulation portion 53 includes an input device. The input device includes multiple mechanical switches dispoed at the navigation apparatus 5 and a touch-sensitive panel disposed on a display screen of the image display device 52. The manipulation portion 53 outputs a signal to the control circuit 57 based on the pressing down of the mechanical switch or the touching of the touch-sensitive panel by the driver of the vehicle.

The wireless communication device 55 is a wireless communication device that performs known operations such as amplification, frequency conversion, modulation, demodulation and the like to transmit and receive a wireless signal by a predetermined communication method. The predetermined communication method is for example a method using frequency modulation (FM), which is robust against noise. The wireless communication device 55 operates under control of the controller 43. In the following, it is assumed that the navigation apparatus 5 uses the wireless communication device 55 when the control circuit 57 communicates with the portable warning terminal 4.

The map data acquisition device 56 includes a non-volatile storage medium such as CD, DVD, HDD and the like. The map data acquisition device 56 further includes a device that reads data from the storage medium and that may write data to the storage medium. The storage medium stores therein program for being executed by the control circuit 57, map data for route guidance, and the like.

The map data includes road data and facility data. The road data includes information about positions of links, information about road types (road categories) of links, information about positions of nodes, information about types (categories) of nodes, and information about connection relationships between nodes and links, and the like. The information about a road category of a link indicates a road category to which the link belongs to. The road categories are, for example, a main road (e.g., main street), a residential road (e.g., side street, living street) and the like. The facility data includes multiple records on a facility-by-facility basis. The respective records indicate names, positions, addresses, and categories etc. of the facilities.

The control circuit 57 includes a micro computer having a CPU, a RAM, ROM, I/O etc. The CPU reads out a program for operation of the navigation apparatus 5 from the ROM or the map data acquisition device 56, and executes the program. In executing the program, the CPU reads out information from the RAM, the ROM and the map data acquisition device 56, and writes information to the RAM and may write information to the storage medium of the map data acquisition device 56. The CPU transmits signals to and receives signals from the position detection device 51, the image display device 52, the manipulation portion 53, the speaker 54 and the wireless communication device 55.

By executing a program, the control circuit 57 performs a navigation process as one of exemplary processes. In the navigation process, based on a driver's input of a destination via the manipulation portion 53, the control circuit 57 calculates an optimal guidance route to the inputted destination and conducts route guidance along the calculated guidance route. Other processes to be performed by the control circuit 57 will be described later.

Operation of the vehicle approach, warning system will be described below.

Figure 4:
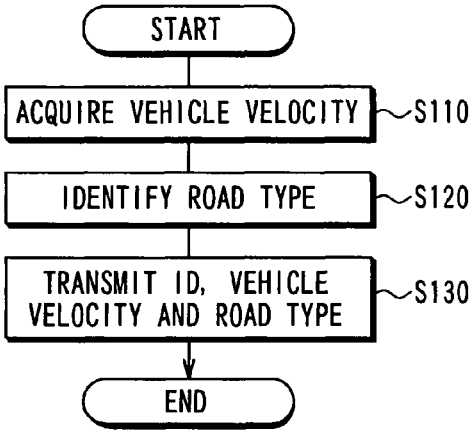
FIG. 4 is a flowchart illustrating a vehicle side transmission process.
Figure 5:
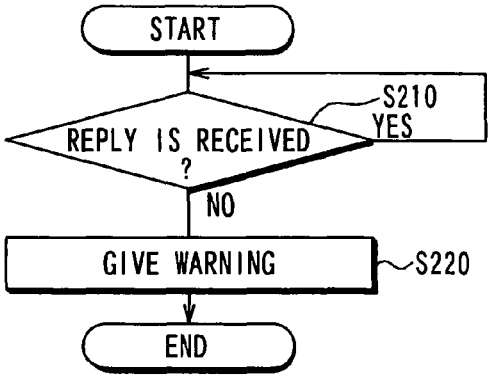
FIG. 5 is a flowchart illustrating a vehicle side reception process.
Figure 6:
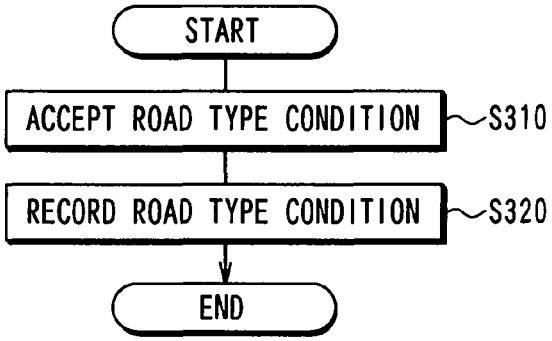
FIG. 6 is a flowchart illustrating a portable side setting process according to a first embodiment.
Figure 7:
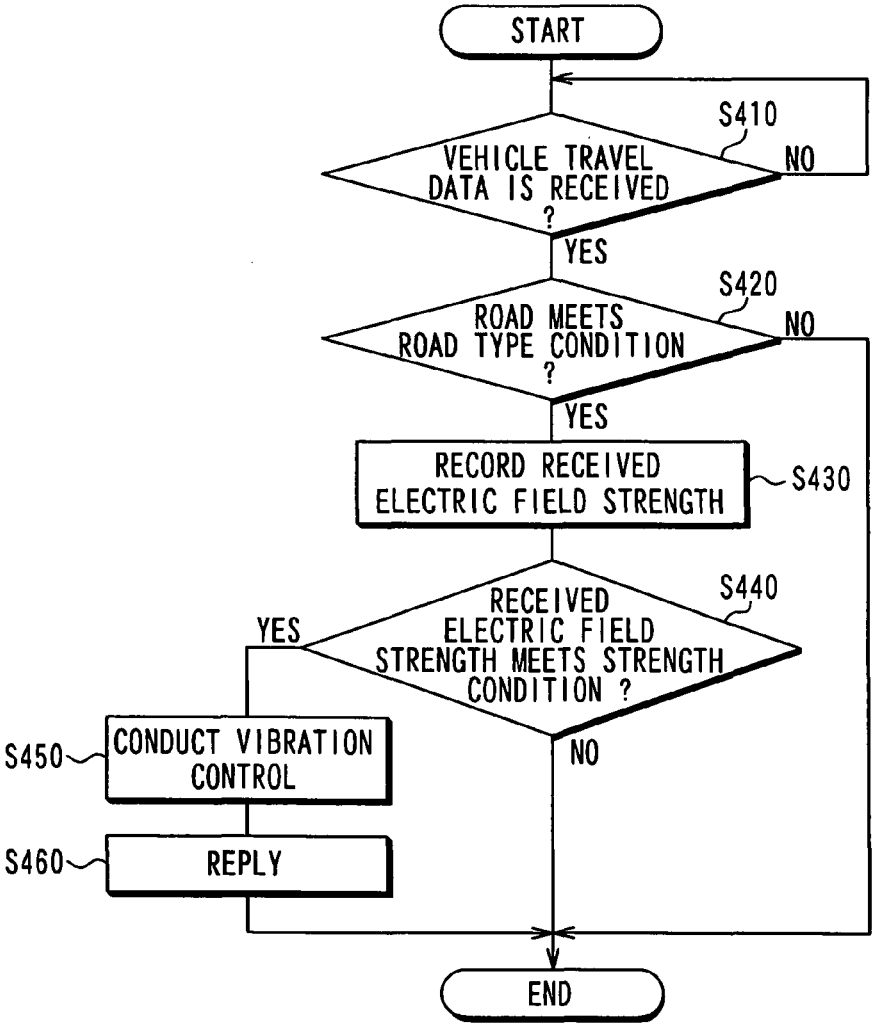
FIG. 7 is a flowchart illustrating a portable side main process according to the first embodiment.

FIGS. 4 and 5 are flowcharts illustrating processes that the control circuit 57 of the navigation apparatus 5 performs by executing predetermined programs. FIGS. 6 and 7 are flowcharts illustrating processes that the controller 43 of the portable warning terminal 4 performs by executing predetermined programs.

The pedestrian 2 carrying the portable warning terminal 4 can prospectively set a road category condition in the portable warning terminal 4. When a predetermined setting start manipulation on the manipulation portion 40 is performed, the controller 43 start performing a portable side setting process illustrated in FIG. 6. First, at S310, the controller device 43 accepts an input of a road category condition from the pedestrian 2 via his or her manipulation on the manipulation portion 40.

The road category condition is a condition of road category for permitting execution of vibration control of the vibrator 42. For example, at S310, the controller 43 accepts an input of selection operation, which selects one road category condition from multiple road category conditions including a first road category condition, a second road category condition and a third road category condition.

(1) The first road category condition is that execution of vibration control of the vibrator 42 is always permitted, i.e., the execution is permitted regardless of road category.

(2) The second road category condition is that the execution is permitted in only the residential road.

(3) The third road category condition is that the execution is always prohibited, i.e., the execution is prohibited in any road regardless of road category.

The above selection operation is an example of an operation for input of a road category condition.

When the operation for an input of a road category is accepted, the process proceeds to S320. At S320, the road category condition corresponding to the accepted operation is recorded in the RAM or the flash memory. In the above, if there is the road category condition that was recorded in past, this old road category condition is deleted. After S320, the portable side setting process is ended.

The control circuit 57 of the navigation apparatus 5 performs a vehicle side transmission process at regular time intervals (e.g., 0.3 seconds interval) when the vehicle 3 is traveling. First, at S110, the control circuit 57 acquires present travel velocity of the vehicle 3 based on a signal from the vehicle speed sensor of the position detection device 51.

At S120, the control circuit 57 specifies the present position of the vehicle 3 based on a signal from the position detection device 51, and further, the control circuit 57 identifies a road category to which a vehicle-locating road belongs. The vehicle-locating road is a road on which the present location of the vehicle 3 is presently located. At S120, for example, the control circuit 57 identifies whether the present position of the vehicle is in the main road or the residential road.

At S130, the control circuit 57 causes the wireless communication device 55 to transmit vehicle travel data to the surroundings of the vehicle 3. After S130, this time vehicle side transmission process is ended. The vehicle travel data includes a vehicle-associated ID, information about the vehicle velocity acquired at S110, and information about the road category identified at S120. The vehicle-associated ID is for example an ID of the vehicle 3, an ID of the navigation apparatus 5 or the like.

Transmission power at a time of transmitting the vehicle travel data is fixed at a predetermined constant value. That is, the vehicle travel data is transmitted from one vehicle 3 with the same transmission power at any time. The navigation apparatus 5 is mounted to not only the vehicle 3 but also multiple vehicles other than the vehicle 3. In one navigation apparatus, the vehicle travel data is transmitted with the same transmission power at any time. Among the multiple navigation apparatuses including the navigation apparatus 5, the transmission power is to set to the same value. For example, the transmission power may be set to such a value that the vehicle travel data can be received by the portable warning terminal 4 spaced apart from the vehicle 3 by 100 m to 200 m.

The above vehicle side transmission process is repeated at regular intervals; thereby, the vehicle travel data is transmitted from the vehicle 3 to the surroundings of the vehicle 3 at regular intervals.

When the portable warning terminal 43 is in operation, the controller 43 of the portable warning terminal 43 measures elapse of time by using a timer (not shown) and performs a portable side main process illustrated in FIG. 7 at regular intervals (e.g., 0.1 second interval) based on the measured elapse of time. In the portable side main process, at S410, the controller 43 waits until the transceiver 41 receives the vehicle travel data wirelessly transmitted from the vehicle. When the vehicle travel data is received, corresponding to YES at S410, the process proceeds to S420. At S420, based on the received vehicle travel data, the controller 43 determines whether a pedestrian-walking road meets the street condition. In the above, the pedestrian-walking road is a road on which the pedestrian 2 is walking.

More specifically, the controller 43 determines whether the road category indicated in the received vehicle travel data meets the road category condition stored in the RAM or the flash memory of the controller 43. For example, when the stored road category condition is the above-described second road category condition, the road category indicated in the vehicle travel data meets the road category condition if the road category indicated in the vehicle travel data is the residential road. If the road category indicated in the vehicle travel data is not the residential road, the road category indicated in the vehicle travel data does not meet the road category condition.

The determination at S420 is used to determine whether the road category of the pedestrian-walking road meets the predetermined road category condition. However, the data actually used in the above determination is the road category indicated in the vehicle travel data, that is, the road category of the road on which the vehicle 3 is traveling. Since the portable warning terminal 4 receives the vehicle travel data, it is highly likely that the vehicle 3 and the pedestrian 2 are on the same road. Therefore, even when the road category indicated in the vehicle travel data and the road category of the pedestrian-walking road are assumed to be the same, this assumption poses little problem.

When the pedestrian-walking road (i.e., a road on which the pedestrian 2 is walking) does not meet the road category condition, this portable side main process is ended without notifying anything to the pedestrian 2. That is, the controller 43 prohibits the warning about the vehicle approach from being given to the pedestrian 2. According to this way, it is possible to give notification while selecting a road on which a pedestrian requires the notification. It is possible to reduce a possibility of uselessly giving a warning about vehicle approach and providing bothersome feeling to the pedestrian on a road where it is unnecessary to give the warning about vehicle approach. Moreover, since the pedestrian 2 by himself or herself can set up the above-described road category condition, the vehicle approach warning system can be built so as to be friendly to the pedestrian 2.

When the pedestrian-walking road (i.e. the road on which the pedestrian 2 is walking) meets the road category condition, corresponding to YES at S420, the process proceeds to S430. At S430, based on the electric field strength signal acquired from the transceiver 41, the controller 43 identifies the electric field strength at a time of receiving the vehicle travel data and records the identified electric field strength in the RAM or the flash memory.

Figure 8:
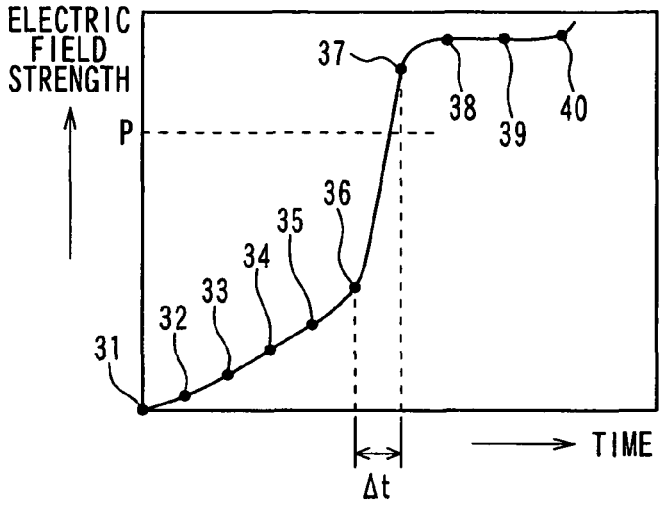
FIG. 8 is a graph illustrating a change in received electric field strength of vehicle travel data transmitted from the same vehicle.

In the above, the electric field strengths are recorded in temporal sequence together with the reception times so that the recorded electric field strengths are classified according to vehicle-associated ID. More specifically, an electric field strength and a reception time at the time of receiving the vehicle travel data are recorded at a tail end of time-series data that corresponds to a vehicle side ID in the received vehicle travel data. The portable side main process in FIG. 4 is repeatedly performed. Thereby, when the vehicle 3 approaches the pedestrian 2 on a road belonging to a certain road category meeting the road category condition, the electric field strengths and the reception times at times of receiving the vehicle travel data, which are repeatedly transmitted from the vehicle 3, are recorded as data like the points 31 to 40 shown in FIG. 8. The data more than a predetermined time of period ago (e.g., more than 10 seconds ago) may be deleted.

At S440, the controller 43 determines whether the electric field strength at the time of receiving the vehicle travel data meets a predetermined strength condition. In the above, it is assumed that the vehicle travel data is transmitted from the vehicle 3. The strength condition is a combination of a first condition (A) and a second condition (B). The first condition (A) is that the received electric field strength at the time of receiving the latest vehicle travel data is larger than a predetermined threshold P. The second condition (B) is that a rate of change in the received electric field strength at the time of receiving the latest vehicle travel data is larger than a predetermined threshold Q.

For example, a rate of change in the received electric field strength at the time of receiving the latest vehicle travel data can be obtained in the following way. The received electric field strength 36 at the time of receiving the previous vehicle travel data (one time ago) is subtracted from the received electric field strength 37 at the time of receiving the latest vehicle travel data having the same vehicle-associated ID, and a result of this subtraction is divided by a period of time $\Delta t$ between the previous reception and the latest reception.

Of the above-described strength conditions, the satisfying of the first condition (A) indicates that the vehicle 3 is so close to the pedestrian 2 that the warning is necessary. In the present embodiment, the predetermined threshold P may be, for example, a value of the received electric field strength in a case where the vehicle 3 is spaced 50 meters apart from the pedestrian 2.

Of the above-described strength conditions, the satisfying of the second condition (B) indicates that the vehicle 3 is approaching the pedestrian 2 at so high velocity that the warning is necessary. In the present embodiment, the predetermined threshold Q may be, for example, a value of the rate of change in the received electric field strength in a case where the vehicle 3 is approaching the pedestrian 2 at a speed of 20 km/h.

When the electric field strength of the received vehicle travel data does not meet the predetermined strength condition, corresponding to NO at S440, this time portable side main process is ended because it is unnecessary to issue the notification to the pedestrian 2. When the electric field strength of the received vehicle travel data meets the predetermined strength condition, corresponding to YES at S440, the process proceeds to S450. At S450, the controller 43 performs the vibration control.

The vibration control is vibration control of the vibrator 42. More specifically, the vibration control continuously vibrates the vibrator 42 without stopping vibration during a period of multiple cycle length, thereby giving the vibration to the pedestrian 2 to warn the pedestrian 2 about the approach of the vehicle 3.

In the vibration control, frequency of the vibration is made larger as the vehicle velocity indicated in the latest received vehicle travel data is larger. A relationship between the frequency of the vibration and the vehicle velocity is, for example, linear. For example, the frequency in a case of 20 km/h and that in a case of 50 km/h are respectively set to 10 Hz and 50 Hz, and the frequency is linearly changed with the vehicle velocity while amplitude is being maintained at a constant value S1.

Figure 9:
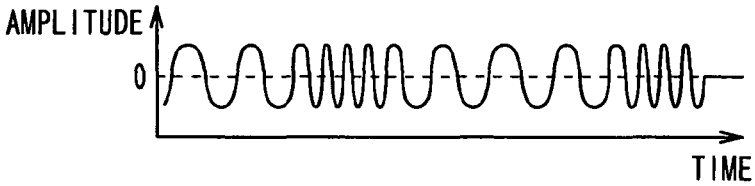
FIG. 9 is a graph illustrating a vehicle velocity dependent change in frequency.

The frequency of vibration of the vibrator 42 is changed in accordance with a change in vehicle velocity of the vehicle 3 approaching the pedestrian 2, as shown in the graph of FIG. 9 for example. In FIG. 9, a horizontal axis indicates time and a vertical axis indicates amplitude of the vibration.

Figure 10:
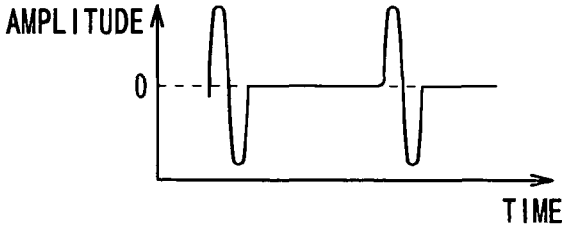
FIG. 10 is a graph illustrating pulsed vibrations.

When the received electric field strength at the time of receiving the latest vehicle travel data becomes greater than or equal to a threshold R larger than the above-described predetermined threshold P, that is, when the vehicle 3 becomes much closer to the pedestrian 2 compared to the start of the notification, the vibrator 42 may generate pulsed vibration. The pulsed vibration refers to such vibration that the vibrator 42 intermittently vibrates with an amplitude S2 for a period of one cycle length in each intermittent vibration, as shown in FIG. 10. For example, the pulsed vibration intermittently vibrates at time intervals of 0.2 seconds. The amplitude S2 is larger than the amplitude S1

As can be seen from the above, when the vehicle 3 becomes much closer to the pedestrian 2 compared to the start of the notification, a manner of the vibration is qualitatively changed. Therefore, it is possible to give a strong warning to the pedestrian 2.

At S460, the controller 43 replies to the vehicle 3 by using the transceiver 41. A reply signal contains the vehicle-associated ID that was contained in the received latest vehicle travel data. The vehicle-associated ID in the reply signal indicates a reply destination.

The control circuit 57 of the navigation apparatus 5 repeatedly performs a vehicle side reception process illustrated in FIG. 5. At S210, the control circuit 57 waits until receiving the reply containing the vehicle-associated ID of the self-vehicle 3. When the control circuit 57, receives the reply, corresponding to YES at S210, the process proceeds to S220. At S220, the control circuit 57 issues the warning notification to the driver by using one of or both of sound and image. The warning notification has contents for informing the driver that a person carrying the portable warning terminal 4 exists at a place close to the vehicle 3. When the navigation apparatus 5 receives the reply from the portable warning terminal 4 of the pedestrian 2 and issues the warning notification in the above way, the driver of the vehicle 3 can be aware that a person carrying the portable warning terminal 4 exists at a place close to the vehicle 3, and the driver can drive the vehicle 3 with much care.

As described above, when the controller 43 of the portable warning terminal 4 receives the vehicle travel data wirelessly transmitted from the in-vehicle communication apparatus 5, the controller 43 gives the warning about the vehicle approach to the pedestrian 2 by using vibration if (i) the electric field strength at the time of receiving the vehicle travel data is larger thae the threshold P and/or (ii) the rate of change in the electric field strength at the time of receiving the latest vehicle travel data is larger than the predetermined threshold Q.

The electric field strength increases with decreasing distance between the vehicle 3 and the pedestrian 2. Because of the use of the received electric field strength, it is possible to detect whether the vehicle 3 is so close to the pedestrian that the warning is necessary, and it is possible to detect whether the vehicle is approaching the pedestrian at so high speed that the warning is necessary, and it is possible to give the warning to the person in a way other than auditory stimulation.

The vehicle travel data includes data indicative of the vehicle velocity of the vehicle 3. In accordance with the vehicle velocity of the vehicle 3 indicated in the received vehicle travel data, the portable warning terminal 4 alters a manner of the warning about the vehicle approach. Because of this, since the pedestrian 2 can catch a change in velocity of the vehicle 3, the pedestrian 2 can pay attention to the vehicle 3 in a more appropriate manner.

In the above, by performing S440 in FIG. 7, the controller 43 can act as an example of a determination section or means. By performing S450, the controller 43 can act as an example of a pedestrian side warning means or section. By performing S130 in FIG. 4, the control circuit 57 of the navigation apparatus 5 can act as an example of a transmission means or section. By performing S220 in FIG. 5, the control circuit 57 can act as an example of a vehicle side warning means or section.

Second Embodiment

A second embodiment will be described below. A difference from the first embodiment will be focused on. The present embodiment and the first embodiment can be the generally same in configuration and operation of the navigation apparatus 5 mounted to the vehicle 3. That is, the navigation apparatus 5 can have a configuration illustrated in FIG. 3. The control circuit 57 can perform processes illustrated in FIG. 4, FIG. 5 etc.

In the present embodiment, a vehicle ID is used as the vehicle-associated ID, which the control circuit 57 transmits at S130 in FIG. 4. The vehicle ID and the vehicle-associated ID are the same in that each of the vehicle-associated ID and the vehicle ID contains the data that is individually assigned to each vehicle for individual vehicle identification. However, the vehicle ID further contains data for identifying a vehicle category to which the self-vehicle belongs to.

Figure 11:
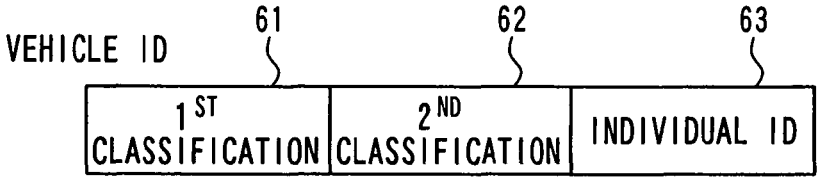
FIG. 11 is a diagram illustrating a configuration of a vehicle ID according to a second embodiment.

FIG. 11 is a diagram illustrating a configuration of a vehicle ID of the present embodiment. As shown in FIG. 11, the vehicle ID includes three parts, which are a first classification part 61, a second classification part 62 and an individual ID part 63. The first classification part 61 and the second classification part 62 are an example of a vehicle category indicator part.

The first classification part 61 indicates a vehicle category to which the self-vehicle 3 belongs. The vehicle category indicated in the first classification part 61 is, for example, fixed route bus, taxi, large truck, a passenger car, a two-wheel vehicle, police vehicle, fire-extinguishing vehicle, and ambulance vehicle etc. That is, the first classification part 61 is associated with categories that are classified according to vehicle application. The second classification part 62 also indicates a vehicle category to which the self-vehicle 3 belongs. The vehicle category indicated in the second classification part 62 is, for example, fuel engine vehicle, hybrid vehicle, and electric vehicle etc. That is, the second classification part 62 is associated with categories that are classified according to drive power source. The individual ID part 63 includes the data that is individually assigned to each vehicle for individual vehicle identification.

The portable warning terminal 4 of the present embodiment can have the generally same configuration as that of the first embodiment. As for operation of the portable warning terminal 4 of the present embodiment, the controller 43 performs a portable side setting process illustrated in FIG. 12 in place of the portable side setting process illustrated in FIG. 6. Further, the controller 43 performs a portable side main process illustrated in FIG. 13 in place of the portable side main process illustrated in FIG. 7.

Figure 12:
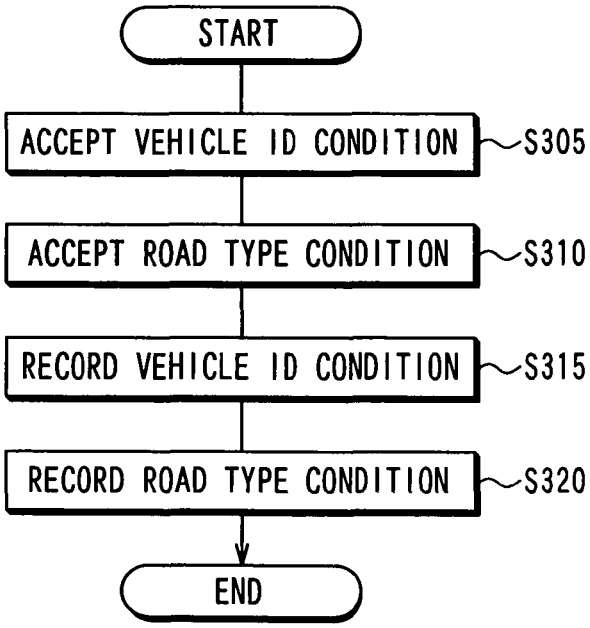
FIG. 12 is a flowchart illustrating a portable side setting process according to the second embodiment.

Like numerical references are used to refer to like steps between FIG. 6 and FIG. 12. Further, like numerical references are used to refer to like steps between FIG. 7 and FIG. 13. Therefore, in the present embodiment, explanation on such like steps may be omitted or simplified.

In the portable side setting process in FIG. 12, the controller 43 performs the following. First, at S305, the controller 43 accepts an input of setting a vehicle ID condition from the pedestrian 2 via his or her manipulation on the manipulation portion 40. The vehicle ID condition includes two kinds of condition, which are a vehicle ID warning condition and a vehicle ID reply condition. At S305, the controller 43 can accept the input of setting one of or both of the two conditions.

The vehicle ID warning condition defines which of vehicle IDs servers as a warning trigger object, and defines which of vehicle IDs is excluded from the warning trigger object. The vehicle ID warning condition further defines a manner of warning in relation to each vehicle ID that serves as the warning trigger object.

Variety can be provided to a combination of the setting of the vehicle IDs serving as the warning trigger object and the setting of the vehicle IDs excluded from the warning trigger object. Examples are as follows. A condition for a vehicle. ID to serve as the warning trigger object may be set to "arbitrary vehicle ID", and a condition for a vehicle ID to be excluded from the warning trigger object may be set to "none", which means none of vehicle IDs is excluded from the warning trigger object. Alternatively, the condition for a vehicle ID to serve as the warning trigger object may be set to "a specific vehicle ID or any vehicle ID that has the first classification part 61 indicating taxi". The condition for a vehicle ID to be excluded from the warning trigger object may be set to "arbitrary vehicle ID other than the vehicle IDs serving as the warning trigger object". Alternatively, the condition for a vehicle ID to serve as the warning trigger object may be set to "arbitrary vehicle ID other than a specific vehicle ID that is excluded from the warning trigger object", and the condition for a vehicle ID to be excluded from the warning trigger object may be set to "the specific vehicle ID".

As to the vehicle ID serving as the warning trigger object, a value of the threshold P of the received electric field strength is settable as a manner of the warning. For example, the threshold P of the received electric field strength may be set to the same value between all vehicle IDs serving as the warning trigger object. Alternatively, among the vehicles IDs serving as the warning trigger object, the threshold P of the received electric field strength for a vehicle ID corresponding to a specific vehicle category (e.g., a large truck, taxi) may be set to a smaller value than that for other vehicle IDs.

The vehicle ID reply condition defines which of vehicle IDs necessitates a reply to the vehicle 3, and which of vehicle IDs does not necessitate the reply to the vehicle 3.

A combination of setting of vehicle IDs necessitating the reply to the vehicle 3 and setting of vehicle IDs not necessitating the reply to the vehicle 3 is settable in a manner similar to those described above in the vehicle ID warning condition. In addition, the vehicle ID reply condition can have, for example, such a setting that "whatever vehicle ID is, a reply to the vehicle 3 is prohibited".

After S305, the process proceeds to S310. At S310, the controller 43 accepts the setting of the road category condition in the substantially same manner as that in the first embodiment. At S315, the controller 43 records the vehicle ID condition, which was accepted and was set at S305, in the RAM or the flash memory. In recording, the controller 43 may delete a vehicle ID recorded in past condition if such an old vehicle ID condition exists. After S315, the controller 43 performs S320, content of which is the substantially same as that in the first embodiment.

Figure 13:
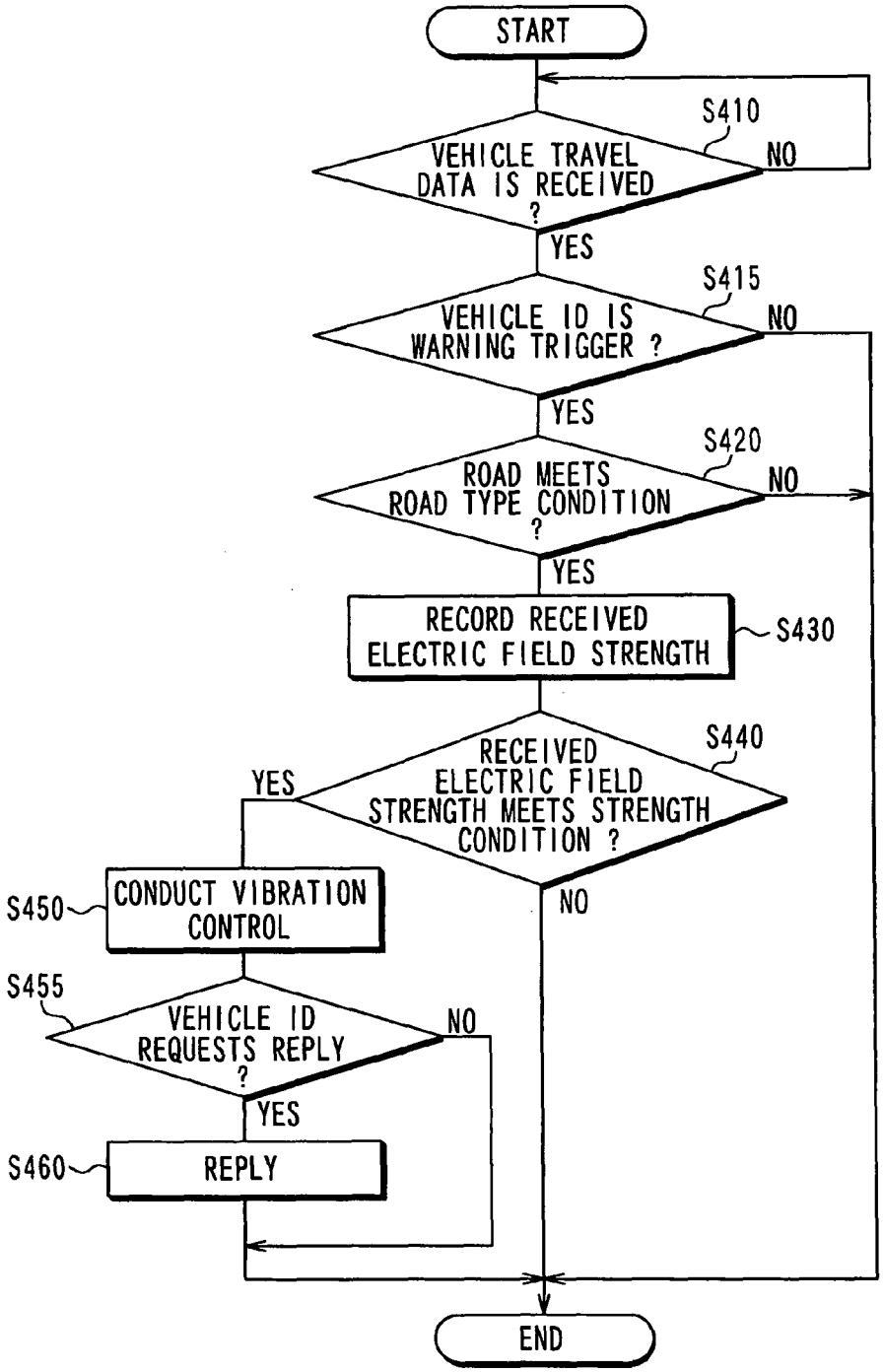
FIG. 13 is a flowchart illustrating a portable side main process according to the second embodiment.

In the portable side main process illustrated in FIG. 13, the controller 43 performs the following. At S410, the controller 43 receives the vehicle travel data wirelessly transmitted from the vehicle 3. At S415, the controller 43 determines whether the vehicle ID in the received vehicle travel data servers as the warning trigger object, based on the vehicle ID warning condition recorded at S315 in FIG. 12.

For example, the vehicle ID warning condition recorded at S315 may indicate that the warning trigger object is "any vehicle ID having the first classification part 61 indicating taxi". In this case, when the first classification part 61 of the vehicle ID in the received vehicle travel data indicates taxi, it is determined at S415 that the vehicle ID serves as the warning trigger object regardless of contents of the second classification part 62 and the individual ID part 63.

In another example case, the vehicle ID warning condition recorded at S315 may indicate that the warning trigger object is any vehicle ID whose first classification part 61 indicates taxi and whose second classification part 62 indicates electric vehicle. In this case, when the first classification part 61 of the vehicle ID in the received vehicle travel data indicates taxi and the second classification part 62 indicate electric vehicle, it is determined at S415 that the vehicle ID serves as the warning trigger object regardless of content of the individual ID part 63.

In yet another example case, the vehicle ID warning condition recorded at S315 may indicate that the vehicle ID excluded from the warning trigger object is any vehicle ID whose the second classification part 62 indicates fuel engine vehicle. In this case, when the second classification part 62 of the vehicle ID in the received vehicle travel data indicates fuel engine vehicle, it is determined at S415 that the vehicle ID does not serve as the warning trigger object regardless of contents of the first classification part 61 and the individual ID part 63.

When it is determined at S415 that the vehicle ID serves as the warning trigger object, the determination YES is made at S415, and the process proceeds to S420. When it is determined at S415 that the vehicle ID does not serve as the warning trigger object, corresponding to NO at S415, this time portable side main process is ended without notifying anything to the pedestrian 2. That is, the warning to the pedestrian 2 about the vehicle approach is prohibited.

At S420, the controller 43 determines whether the road category condition is satisfied. At S430, the controller 43 records the received electric field strength on an ID basis. At S440, the controller 43 determines whether the electric field strength at the time of receiving the vehicle travel data from the vehicle 3 meets the predetermined strength condition. Like the strength condition of the first embodiment, the strength condition of the present embodiment is that (A) the received electric field strength at the time of receiving the latest vehicle travel data is larger than the predetermined threshold P, and (B) the rate of change in the received electric field strength at the time of receiving the latest vehicle travel data is larger than the predetermined threshold Q. The threshold P used in the above is one that is set in the vehicle ID warning condition so as to be associated with the vehicle ID in the received vehicle travel data from the vehicle 3. If a threshold P associated with the vehicle ID in the received vehicle travel data from the vehicle 3 is not set in the vehicle ID warning condition, a predetermined default value is employed as the threshold P. When the controller 43 determines at S440 that the received electric field strength meets the predetermined strength condition, corresponding to YES at S440, the process proceeds to S450. At S450, the controller 43 performs the vibration control.

As described above, based on the setting made by a user (e.g., the pedestrian), the portable warning terminal 4 prospectively stores therein the vehicle ID warning condition and uses the vehicle ID warning condition at the S415. Thereby, it is possible to switch between execution and non-execution of the warning with use of the vibrator 42 on a vehicle category basis or on an individual vehicle basis. In the above, the vehicle ID warning condition defines which of vehicle IDs serves as the warning trigger object and which of vehicle IDs is excluded from the warning trigger object.

For example, when a vehicle ID of a specific vehicle (e.g., a vehicle ID of a vehicle owned by user's family, a vehicle ID of a chauffeur vehicle, and the like) is set to serve as the warning trigger object in the vehicle ID warning condition, the approach of the specific vehicle is surely and reliably recognizable.

Alternatively, when a person would like to get a taxi, it is possible to surely and reliably recognize approach of the taxi if "any vehicle ID having the first classification part 61 indicating taxi" is set to serve as the warning trigger object in the vehicle ID warning condition.

Alternatively, the vehicle ID warning condition can be set so that a vehicle ID of a vehicle carrying the user of the portable warning terminal 4 is set as a vehicle ID of a specific vehicle excluded from the warning trigger object. By using this setting, it is possible to prevent generation of useless warning.

Alternatively, based on the setting made by the user (i.e., the pedestrian 2), the portable warning terminal 4 can prospectively store the threshold "P" of the received electric field strength for the vehicle ID serving as the warning trigger object. At S440, the portable warning terminal 4 can use the prospectively-stored threshold P, and thereby, the portable warning terminal 4 can change timing of starting the warning on a vehicle category basis or an individual vehicle basis.

For example, any vehicle ID having the first classification part 61 indicating large truck may be set to serve as the warning trigger object in the vehicle ID warning condition. The threshold P for any vehicle ID having the first classification part 61 indicating large truck may be set to a value smaller than the thresholds P for other vehicle IDs. In this case, a user can quickly and preferentially recognize the approach of a large truck at an early stage where the large truck is so distant that the electric field strength is weak. The user can promptly take action for safety such as moving to corner of a sidewalk and the like.

After S450, the process proceeds to S455. At S455, the controller 43 determines whether the vehicle ID in the received vehicle travel data necessitates a reply to the vehicle according to the vehicle ID reply condition recorded at S315 in FIG. 12.

For example, the vehicle ID reply condition recorded at S315 may indicate that the vehicle ID necessitating the reply to the vehicle is "any vehicle ID having the second classification part 62 indicating hybrid vehicle". In this case, when the second classification part 62 of the vehicle ID in the received vehicle travel data indicates hybrid vehicle, it is determined at S455 that the vehicle ID in the received vehicle travel data necessitates a reply to the vehicle, regardless of contents of the first classification part 61 and the individual ID part 63.

In another example case, the vehicle ID reply condition recorded at S315 may indicate that the vehicle ID prohibiting the reply to the vehicle is "any vehicle ID that has the first classification part 61 indicating normal passenger car and the second classification part 62 indicating fuel engine vehicle". In this case, when the first classification part 61 of the vehicle ID in the received vehicle travel data indicates normal passenger car and the second classification par 62 indicates fuel engine vehicle, it is determined at S415 that the vehicle ID in the received vehicle travel data does not necessitate the reply to the vehicle regardless of content of the individual ID part 63.

In yet another example case, the vehicle ID reply condition recorded at S315 may indicate that "whatever vehicle ID is, the reply to the vehicle 3 is unnecessary". In this case, whatever the vehicle ID in the received vehicle travel data is, it is determined at S455 that the vehicle ID does not necessitate the reply to the vehicle 3.

When it is determined at S455 that the vehicle ID necessitates the reply, the determination YES is made at S455, and the process proceeds to S460. At S460, the controller 43 conducts the reply to the vehicle 3 in the substantially same manner as that in the first embodiment. When it is determined at S455 that the vehicle ID does not necessitate the reply, corresponding to NO at S455, this time portable side main process is ended without the reply to the vehicle 3. That is, the reply to the vehicle 3 is prohibited.

As described above, based on the setting made by a user (i.e., the pedestrian 2), the portable warning terminal 4 prospectively stores therein the vehicle ID reply condition defining which of vehicle IDs necessitates the reply and which of vehicle IDs does not necessitate the reply. The portable warning terminal 4 uses the stored vehicle ID reply condition at S455. Thereby, on a vehicle category basis or on an individual vehicle basis, the portable warning terminal 4 can switch between execution and non-execution of the reply to the vehicle after warning the pedestrian 2 with use of the vibrator 42.

For example, the vehicle ID reply condition can be set in the following way. The vehicle ID necessitating the reply may be a vehicle ID of a specific vehicle to which the pedestrian 2 would like to inform the presence of himself or herself (cf. in a case of rendezvous). Other vehicle IDs may be set as the vehicle IDs that do not necessitate the reply. In this setting, it is possible to surely and reliably inform the presence of the pedestrian 2 to the specific vehicle. Further, since the reply is not sent to vehicles to which the reply is unneeded, it is possible to reduce wireless communication traffic. Furthermore, since the presence of a user is not informed to the general public vehicles, it is possible to prevent, with high possibility, an occurrence of crimes such as kidnapping and the like.

Alternatively, the vehicle ID reply condition may be set so that vehicle IDs of vehicles owned by persons living around a home of the pedestrian 2 are set as the vehicle IDs that do not necessitate the reply. In this setting, it is possible to reduce wireless communication traffic, and it is possible to prohibit a reply to an in-vehicle apparatus to which an issue of caution is unneeded.

Other Embodiments

The above embodiments can be modified in various ways, examples of which will be described below.

In the above embodiments, when the portable warning terminal 4 receives the vehicle travel data wirelessly transmitted from the in-vehicle communication device 5, the portable warning terminal 4 warns the pedestrian 2 about the vehicle approach through giving the vibration if the electric field strength at the time of receiving the vehicle travel data is larger than the threshold P and if the rate of change in the electric field strength at the time of receiving the vehicle travel data is larger than the threshold Q.

A condition relating to the threshold Q may not be essential. More specifically, if the electric field strength at the time of receiving the vehicle travel data is larger than the threshold P, the portable warning terminal 4 may warn the pedestrian 2 about the vehicle approach via the vibration regardless of the rate of change in the electric field strength at the time of receiving the vehicle travel data.

The portable warning terminal 4 may perform the vibration control so that the amplitude of the vibration is larger as the received electric field strength at the time of receiving the latest vehicle travel data is larger. Alternatively, the portable warning terminal 4 may perform the vibration control so that the frequency of the vibration is larger as the received electric field strength at the time of receiving the latest vehicle travel data is larger.

In the above embodiments, giving tactile stimulation with use of the vibration of the vibrator 42 is described as an example of warning the vehicle approach in a way other than auditory stimulation. However, the way other than auditory stimulation is not limited to the above example. For example, visual stimulation may be used. Specifically, the warning about the vehicle approach may be given through turning on or blinking a lamp such as LED (light-emitting diode) and the like.

When the controller 43 of the portable warning terminal 4 gives the warning about the vehicle approach in a way other than vibration also, the controller 43 may alter a manner of the warning about the vehicle approach in accordance with the travel velocity of the vehicle indicated in the received vehicle travel data. For example, the light brightness may be made larger as the travel velocity of the vehicle is larger.

Further, when the controller 43 of the portable warning terminal 4 warns about the vehicle approach in a way other than vibration also, the controller 43 may alter a manner of the warning about the vehicle approach in accordance with the electric field strength at the time of receiving the latest vehicle travel data. For example, the light brightness may be made larger as the received electric field strength is larger.

In the above embodiments, the transmission power at transmission of the vehicle travel data is always kept constant in one navigation apparatus 5. In addition, multiple navigation apparatuses are the same in the transmission power at transmission of the vehicle travel data. However, the transmission power may not be limited to the above example. In the transmission power at transmission of the vehicle travel data, the multiple navigation apparatuses may differ from each other. Even in one navigation apparatus 5, the transmission power at the transmission of the vehicle travel data may change with time. In this case, when the navigation apparatus 5 transmits the vehicle travel data, the navigation apparatus 5 may put, in the vehicle travel data, information about the electric field strength at the transmission of the vehicle travel data. Further, the thresholds P, Q may be different in values from those in the above embodiments, although the controller 43 of the portable warning terminal 4 compares the received electric field strength and its rate of change with time with the thresholds P, Q at S440 in a manner similar to that in the above embodiments.

Specifically, the threshold P may be a constant K times the transmission electric field strength indicated in the vehicle travel data. The constant K may be less than unity and comparable to a decrease rate of electric field strength when a signal of the vehicle travel data propagates 50 meters. The threshold Q may be the constant K times the threshold Q of the above embodiments. The thresholds P, Q may not be limited to constants.

In the above embodiments, the navigation apparatus 5 is an example of an in-vehicle communication apparatus. However, the in-vehicle communication apparatus may not limited to the navigation apparatus 5, and may not have a function of the navigation apparatus. The in-vehicle communication may have only a function of transmitting a signal to the portable warning terminal 4.

In the above embodiments, a value indicative of the travel velocity itself is used as the information about the travel velocity of the vehicle 3 included in the vehicle travel data. Alternatively, the information about the travel velocity may be the following. Frequency of the vehicle speed pulse signal outputted from the vehicle speed sensor is converted to frequency in such a frequency range (e.g., 10 Hz to 100 Hz) that a person can sense the frequency. Waveform data of the frequency obtained by this conversion may be used as the information about the travel velocity and may be included in the vehicle travel data.

In the second embodiment, the vehicle ID in the vehicle ID condition (e.g., the vehicle ID warning condition and the vehicle ID reply condition) can be inputted and set by a user with use of the manipulation portion 40. Alternatively, the controller 43 may receive the vehicle ID condition from an outside of the portable warning terminal 4 by wireless communication. Alternately, as the vehicle ID to be set in the vehicle ID condition, the controller 43 may use a vehicle ID included in vehicle travel data that the portable warning terminal 4 receives from a peripheral vehicle via the transceiver 41.

In the vehicle side transmission process, the navigation apparatus 5 constantly transmits the vehicle travel data at regular intervals. Alternatively, when the vehicle 3 is equipped with an apparatus for detecting a person in front of the vehicle 3, the navigation apparatus 5 may cyclically transmit the vehicle travel data only if the apparatus detects the person in front of the vehicle 3. Alternatively, only if the apparatus detects the person in front of the vehicle 3, the navigation apparatus 5 may transmit the vehicle travel data only one time.

The present disclosure involves the following aspects.

According to a first aspect, a vehicle approach warning system is provided. The vehicle approach warning system includes an in-vehicle communication apparatus mounted to a vehicle and a portable warning terminal carried by a pedestrian. The in-vehicle communication apparatus wirelessly transmits vehicle travel data to surroundings of the vehicle. In response to receiving the vehicle travel data wirelessly transmitted from the in-vehicle communication apparatus, the portable warning terminal warns the pedestrian about approach of the vehicle in a way other than auditory stimulation if electric field strength at a time of receiving the vehicle travel data is larger than a first threshold.

The above vehicle approach warning system uses the received electric field strength, which is larger as the vehicle approaches the pedestrian. By using the received electric field strength, the vehicle approach warning system can detect that the vehicle 3 approaches the pedestrian 2 so closely that the warning is necessary, and can warn a person in a way other than auditory stimulation.

The vehicle approach warning system may be configured as follows. The vehicle travel data includes information about travel velocity of the vehicle. The portable warning terminal alters a manner of warning about the approach of the vehicle in accordance with the travel velocity of the vehicle indicated in the received vehicle travel data.

According to this configuration, the pedestrian can comprehend a change in velocity of the vehicle and thus can more properly take care of the vehicle.

The above vehicle approach warning system may be configured as follows. The in-vehicle communication apparatus identifies a road category to which a vehicle-travel-road belongs. The vehicle-travel-road is a road on which the vehicle is presently located. The in-vehicle communication apparatus puts information about the identified road category in the vehicle travel data. The portable warning terminal determines whether the road category indicated in the vehicle travel data meets a stored road category condition. When the portable warning terminal determines that the road category indicated in the vehicle travel data does not meet the stored road category condition, the portable warning terminal prohibits warning about approach of the vehicle from being given to the pedestrian.

According to this configuration, it is possible to reduce a possibility of uselessly giving the warning about vehicle approach on a road on which the warning about vehicle approach is un-needed. It is possible to reduce a possibility of giving bothersome feeling to the pedestrian.

The above vehicle approach warning system may be configured as follows. The portable warning terminal includes a vibrator. When the portable warning terminal receives the vehicle travel data transmitted wirelessly from the in-vehicle communication apparatus, the portable warning terminal continuously vibrates the vibrator with a first amplitude if the electric field strength at the time of receiving the vehicle travel data is larger than the first threshold, and then the portable warning terminal intermittently vibrates the vibrator with a second amplitude for a period of only one cycle length in each intermittent vibration if the electric field strength becomes greater than or equal to a second threshold. The second amplitude is larger than the first amplitude. The second threshold is larger than the first threshold.

According to this configuration, when the vehicle becomes much closer to the pedestrian compared with the start of the notification, it is possible to give a strong warning to the pedestrian by qualitatively changing a manner of the vibration.

The above vehicle approach warning system may be configured as follows. The vehicle travel data further includes a vehicle ID for individual vehicle identification. The portable warning terminal prospectively stores therein a vehicle ID warning condition that defines which of vehicle IDs serves as a warning trigger object and which of vehicle IDs is excluded from the warning trigger object. When the portable warning terminal receives the vehicle travel data transmitted wirelessly from the in-vehicle communication apparatus, the portable warning terminal determines whether the vehicle ID in the received vehicle travel data serves as the warning trigger object, based on the vehicle ID warning condition and the vehicle ID in the received vehicle travel data. When the portable warning terminal determines that the vehicle ID in the received vehicle travel data serves as the warning trigger object, the portable warning terminal warns the pedestrian about the approach of the vehicle in the way other than the auditory stimulation. When the portable warning terminal determines that the vehicle ID in the received vehicle travel data does not serve as the warning trigger object, the portable warning terminal prohibits warning about the approach of the vehicle from being given to the pedestrian in the way other than the auditory stimulation.

According to the above configuration, the portable warning terminal prospectively stores therein the vehicle ID warning condition showing which of vehicle IDs serves as the warning trigger object and which of vehicle IDs is excluded from the warning trigger object. The portable warning terminal uses the vehicle ID warning condition to make a determination of execution and non-execution of the warning, and thereby can switching between the execution and non-execution of the warning based on the vehicle ID.

The above vehicle approach warning system may be configured as follows. The vehicle travel data includes a vehicle ID for individual vehicle identification. The vehicle ID has a vehicle category indicator part indicative of a vehicle category to which the vehicle belongs. The portable warning terminal prospectively stores therein a vehicle ID warning condition. The vehicle ID warning condition defines which of vehicle IDs having the vehicle category indicator part indicative of the vehicle category servers as a warning trigger object. The vehicle ID warning condition further defines which of vehicle IDs having the vehicle category indicator part indicative of the vehicle category is excluded from the warning trigger object. When the portable warning terminal receives the vehicle travel data wirelessly transmitted from the in-vehicle communication apparatus, the portable warning terminal determines whether the vehicle ID in the received vehicle travel data servers as the warning trigger object, based on the vehicle ID warning condition and the vehicle ID included in the received vehicle travel data. When the portable warning terminal determines that the vehicle ID in the received vehicle travel data dose not serve as the warning trigger object, the portable warning terminal prohibits warning about the approach of the vehicle from being given to the pedestrian in the way other than the auditory stimulation.

According to the above configuration, the portable warning terminal prospectively stores therein the vehicle ID warning condition showing which of vehicle IDs serves as the warning trigger object and which of vehicle IDs is excluded from the warning trigger object. The portable warning terminal uses the vehicle ID warning condition to make a determination of execution and non-execution of the warning, thereby switching between the execution and non-execution of the warning on a vehicle category basis.

The above vehicle approach warning system may be configured as follows. The vehicle ID warning condition prospectively-stored in the portable warning terminal defines the first threshold in relation to the vehicle ID that serves as the warning trigger object. When the portable warning terminal receives the vehicle travel data wirelessly transmitted from the in-vehicle communication apparatus, the portable warning terminal determines the first threshold for the vehicle ID included in the vehicle travel data, based on the vehicle ID warning condition and the vehicle ID included in the vehicle travel data. When the electric field strength at the time of receiving the vehicle travel data is larger than the determined first threshold, the portable warning terminal warns the pedestrian about the approach of the vehicle in the way other than auditory stimulation.

According to the above configuration, the portable warning terminal prospectively stores therein the first threshold P of the received electric field strength for the vehicle ID serving as the warning trigger object. By using the prospectively-stored first threshold, it is possible to change timing of starting the warning on a vehicle category basis or an individual vehicle basis.

The above vehicle approach warning system may be configured as follows. When the portable warning terminal warns the pedestrian about the approach of the vehicle, the portable warning terminal sends a reply to the in-vehicle communication apparatus. When the in-vehicle communication apparatus receives the reply form the portable warning terminal, the in-vehicle communication apparatus gives a warning notification to a driver of the vehicle.

According to the above configuration, when the in-vehicle communication apparatus receives the reply from the portable warning terminal carried by the pedestrian, the in-vehicle communication apparatus gives the warning notification. Thus, the driver of the vehicle can notice that the pedestrian carrying the portable warning terminal exists at a short distance, and can drives the vehicle with much care.

The above vehicle approach warning system may be configured as follows. The vehicle travel data includes a vehicle ID for individual vehicle identification. The portable warning terminal prospectively stores therein a vehicle ID reply condition. The vehicle ID reply condition defines which of vehicle IDs necessitates the reply and which of vehicle IDs does not necessitate the reply. When the portable warning terminal receives the vehicle travel data wirelessly transmitted from the in-vehicle communication apparatus, the portable warning terminal determines whether the vehicle ID in the received vehicle travel data necessitates the reply, based on the vehicle ID reply condition and the vehicle ID in the received vehicle travel data. When the portable warning terminal determines that vehicle ID in the received vehicle travel data necessitates the reply, the portable warning terminal sends the reply to the in-vehicle communication apparatus. When the portable warning terminal determines that the vehicle ID in the received vehicle travel data does not necessitate the reply, the portable warning terminal does not send the reply to the in-vehicle communication apparatus.

According to the above configuration, based on the setting made by the pedestrian, the portable warning terminal can prospectively store therein the vehicle ID reply condition showing which of vehicle IDs necessitates the reply and which of vehicle IDs does not necessitate the reply. Based on the vehicle ID reply condition, the portable warning terminal can make determination of execution and non-execution of the reply, and thereby can switch between the execution and non-execution of the reply based on the vehicle ID.

The above vehicle approach warning system may be configured as follows. The vehicle travel data includes a vehicle ID for individual vehicle identification. The vehicle ID has a vehicle category indicator part indicative of a vehicle category to which the vehicle belongs. The portable warning terminal prospectively stores therein a vehicle ID reply condition. The vehicle ID reply condition defines which of vehicle ID shaving the vehicle category indicator part indicative of the vehicle category necessitates the reply. The vehicle ID reply condition further defines which of vehicle IDs having the vehicle category indicator part indicative of the vehicle category does not necessitates the reply. When the portable warning terminal receives the vehicle travel data wirelessly transmitted from the in-vehicle communication apparatus, the portable warning terminal determines whether the vehicle ID in the received vehicle travel data necessitates the reply, based on the vehicle ID reply condition and the vehicle ID included in the received vehicle travel data. When the portable warning terminal determines that vehicle ID in the received vehicle travel data necessitates the reply, the portable warning terminal sends the reply to the in-vehicle communication apparatus. When the portable warning terminal determines that the vehicle ID in the received vehicle travel data does not necessitate the reply, the portable warning terminal does not send the reply to the in-vehicle communication apparatus.

According to the above configuration, based on the setting made by the pedestrian, the portable warning terminal can prospectively store therein the vehicle ID reply condition showing which of vehicle IDs necessitates the reply and which of vehicle IDs does not necessitate the reply. Based on the vehicle ID reply condition, the portable warning terminal can make determination of execution and non-execution of the reply, thereby switching between the execution and non-execution of the reply on a vehicle category basis.

The above vehicle approach warning system may be configured as follows. In response to receiving the vehicle travel data wirelessly transmitted from the in-vehicle communication apparatus, the portable warning terminal warns the pedestrian about the approach of the vehicle in the way other than auditory stimulation if the electric field strength at the time of receiving the vehicle travel data is larger than the first threshold and if a rate of change in the electric field strength at the time of receiving the vehicle travel data is larger than a change rate threshold.

According to the above configuration, it is possible to give the warning about the vehicle approach in a way other than the auditory stimulation by selecting a case in which the vehicle approaches the pedestrian at such a high speed that the warning is necessary.

According to a second aspect, a portable warning terminal to be carried by a pedestrian is provided. The portable warning terminal includes a determination section and a pedestrian side warning section. In response to receiving a vehicle travel data wirelessly transmitted from an in-vehicle communication apparatus of a vehicle, the determination section determines whether electric field strength at a time of receiving the vehicle travel data is larger than a threshold. The pedestrian side warning section warns the pedestrian about approach of the vehicle in a way other than auditory stimulation when the determination section determines that the electric field strength at the time of receiving the vehicle travel data is larger than the threshold.

As can be seen from the above, the present disclosure may be characterized by a portable warning terminal.

According to a third aspect, an in-vehicle communication apparatus to be mounted to a vehicle is provided. The in-vehicle communication apparatus includes a transmission section and a vehicle side warning section. The transmission section wirelessly transmits vehicle travel data to surroundings of the vehicle. The vehicle side warning section receives a reply from a portable warning terminal carried by a pedestrian and gives a warning notification to a drive of the vehicle if the portable warning terminal receives the vehicle travel data wirelessly transmitted from the transmission section and sends the reply to the in-vehicle communication apparatus.

According to the above in-vehicle communication apparatus, since the in-vehicle communication apparatus gives the warning notification to the driver in response to receiving the reply from the portable warning terminal carried by the pedestrian, the driver of the vehicle can notice that the pedestrian carrying the portable warning terminal exists at a short distance from the vehicle and can drive with much care. In other words, it is possible to inform a driver of a vehicle that a pedestrian carrying a portable warning terminal exists at a short distance from the vehicle.

While the invention has been described above with reference to various embodiments thereof, it is to be understood that the invention is not limited to the above described embodiments and constructions. The invention is intended to cover various modifications and equivalent arrangements. The above embodiments can be modified and/or combined in various ways without departing the scope and sprit of the present invention.

Further, each or any combination of procedures, processes, steps, or means explained in the above may be achieved as a software section or unit (e.g., subroutine) and/or a hardware section or unit (e.g., circuit or integrated circuit), including or not including a function of a related device; furthermore, the hardware section or unit can be constructed inside of a microcomputer.

For example, functions that the control device 43 or the control circuit 57 provide by executing of programs may be achieved by using hardware having such functions. A FPGA (Field Programmable Gate Array, where circuit configuration is programmable) may be used.

Furthermore, the software section or unit or any combinations of multiple software sections or units may be included in a software program, which is contained in a computer-readable storage media or is installed in a computer via a communications network.

What is claimed is:

1. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein the in-vehicle communication apparatus identifies a road category to which a vehicle-travel-road belongs;

the vehicle-travel-road is a road on which the vehicle is presently located;

the in-vehicle communication apparatus puts information about the identified road category in the vehicle travel data;

the portable warning terminal determines whether the road category indicated in the vehicle travel data meets a stored road category condition; and when the portable warning terminal determines that the road category indicated in the vehicle travel data does not meet the stored road category condition, the portable warning terminal prohibits warning about approach of the vehicle from being given to the pedestrian.

2. The vehicle approach warning system according to claim 1, wherein:

the vehicle travel data includes information about travel velocity of the vehicle; and the portable warning terminal alters a manner of warning about the approach of the vehicle in accordance with the travel velocity of the vehicle indicated in the received vehicle travel data.

3. The vehicle approach warning system according to a claim 1, wherein:

when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle.

4. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein the portable warning terminal includes a vibrator;

when the portable warning terminal receives the vehicle travel data transmitted wirelessly from the in-vehicle communication apparatus, the portable warning terminal continuously vibrates the vibrator with a first amplitude if the electric field strength at the time of receiving the vehicle travel data is larger than the first threshold, and then the portable warning terminal intermittently vibrates the vibrator with a second amplitude for a period of only one cycle length in each intermittent vibration if the electric field strength becomes greater than or equal to a second threshold;

the second amplitude is larger than the first amplitude; and the second threshold is larger than the first threshold.

5. The vehicle approach warning system according to claim 4, wherein:

the vehicle travel data includes information about travel velocity of the vehicle; and the portable warning terminal alters a manner of warning about the approach of the vehicle in accordance with the travel velocity of the vehicle indicated in the received vehicle travel data.

6. The vehicle approach warning system according to a claim 4, wherein:

when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle.

7. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein the vehicle travel data further includes a vehicle ID for individual vehicle identification;

the portable warning terminal prospectively stores therein a vehicle ID warning condition that defines which of vehicle IDs serves as a warning trigger object and which of vehicle IDs is excluded from the warning trigger object;

when the portable warning terminal receives the vehicle travel data transmitted wirelessly from the in-vehicle communication apparatus, the portable warning terminal determines whether the vehicle ID in the received vehicle travel data serves as the warning trigger object, based on the vehicle ID warning condition and the vehicle ID in the received vehicle travel data;

when the portable warning terminal determines that vehicle ID in the received vehicle travel data serves as the warning trigger object, the portable warning terminal warns the pedestrian about the approach of the vehicle in the way other than the auditory stimulation; and when the portable warning terminal determines that the vehicle ID in the received vehicle travel data does not serve as the warning trigger object, the portable warning terminal prohibits warning about the approach of the vehicle from being given to the pedestrian in the way other than the auditory stimulation.

8. The vehicle approach warning system according to claim 7, wherein:

the vehicle ID warning condition prospectively-stored in the portable warning terminal defines the first threshold in relation to the vehicle ID that serves as the warning trigger object;

when the portable warning terminal receives the vehicle travel data wirelessly transmitted from the in-vehicle communication apparatus, the portable warning terminal determines the first threshold for the vehicle ID included in the vehicle travel data, based on the vehicle ID warning condition and the vehicle ID included in the vehicle travel data; and when the electric field strength at the time of receiving the vehicle travel data is larger than the determined first threshold, the portable warning terminal warns the pedestrian about the approach of the vehicle in the way other than auditory stimulation.

9. The vehicle approach warning system according to claim 7, wherein:

the vehicle travel data includes information about travel velocity of the vehicle; and the portable warning terminal alters a manner of warning about the approach of the vehicle in accordance with the travel velocity of the vehicle indicated in the received vehicle travel data.

10. The vehicle approach warning system according to a claim 7, wherein:

when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle.

11. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein the vehicle travel data includes a vehicle ID for individual vehicle identification;

the vehicle ID has a vehicle category indicator part indicative of a vehicle category to which the vehicle belongs;

the portable warning terminal prospectively stores therein a vehicle ID warning condition that defines which of vehicle IDs having the vehicle category indicator part indicative of the vehicle category servers as a warning trigger object and which of vehicle IDs having the vehicle category indicator part indicative of the vehicle category is excluded from the warning trigger object;

when the portable warning terminal receives the vehicle travel data wirelessly transmitted from the in-vehicle communication apparatus, the portable warning terminal determines whether the vehicle ID in the received vehicle travel data servers as the warning trigger object, based on the vehicle ID warning condition and the vehicle ID included in the received vehicle travel data; and when the portable warning terminal determines that the vehicle ID in the received vehicle travel data does not serve as the warning trigger object, the portable warning terminal prohibits warning about the approach of the vehicle from being given to the pedestrian in the way other than the auditory stimulation.

12. The vehicle approach warning system according to claim 11, wherein:

the vehicle travel data includes information about travel velocity of the vehicle; and the portable warning terminal alters a manner of warning about the approach of the vehicle in accordance with the travel velocity of the vehicle indicated in the received vehicle travel data.

13. The vehicle approach warning system according to a claim 11, wherein:

when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle.

14. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle;

the vehicle travel data includes a vehicle ID for individual vehicle identification;

the portable warning terminal prospectively stores therein a vehicle ID reply condition that defines which of vehicle IDs necessitates the reply which of vehicle IDs does not necessitate the reply;

when the portable warning terminal receives the vehicle travel data wirelessly transmitted from the in-vehicle communication apparatus, the portable warning terminal determines whether the vehicle ID in the received vehicle travel data necessitates the reply, based on the vehicle ID reply condition and the vehicle ID in the received vehicle travel data;

when the portable warning terminal determines that vehicle ID in the received vehicle travel data necessitates the reply, the portable warning terminal sends the reply to the in-vehicle communication apparatus; and when the portable warning terminal determines that the vehicle ID in the received vehicle travel data does not necessitate the reply, the portable warning terminal does not send the reply to the in-vehicle communication apparatus.

15. The vehicle approach warning system according to claim 14, wherein:

the vehicle travel data includes information about travel velocity of the vehicle; and the portable warning terminal alters a manner of warning about the approach of the vehicle in accordance with the travel velocity of the vehicle indicated in the received vehicle travel data.

16. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle;

the vehicle travel data includes a vehicle ID for individual vehicle identification;

the vehicle ID has a vehicle category indicator part indicative of a vehicle category to which the vehicle belongs;

the portable warning terminal prospectively stores therein a vehicle ID reply condition that defines which of vehicle ID shaving the vehicle category indicator part indicative of the vehicle category necessitates the reply and which of vehicle IDs having the vehicle category indicator part indicative of the vehicle category does not necessitates the reply;

when the portable warning terminal receives the vehicle travel data wirelessly transmitted from the in-vehicle communication apparatus, the portable warning terminal determines whether the vehicle ID in the received vehicle travel data necessitates the reply, based on the vehicle ID reply condition and the vehicle ID included in the received vehicle travel data;

when the portable warning terminal determines that vehicle ID in the received vehicle travel data necessitates the reply, the portable warning terminal sends the reply to the in-vehicle communication apparatus; and when the portable warning terminal determines that the vehicle ID in the received vehicle travel data does not necessitate the reply, the portable warning terminal does not send the reply to the in-vehicle communication apparatus.

17. The vehicle approach warning system according to claim 16, wherein:

the vehicle travel data includes information about travel velocity of the vehicle; and the portable warning terminal alters a manner of warning about the approach of the vehicle in accordance with the travel velocity of the vehicle indicated in the received vehicle travel data.

18. A vehicle approach warning system comprising:

an in-vehicle communication apparatus to be mounted to a vehicle, the in-vehicle communication apparatus being configured to wirelessly transmit vehicle travel data to surroundings of the vehicle; and a portable warning terminal to be carried by a pedestrian, the portable warning terminal being configured to warn, in response to receiving the vehicle travel data wirelessly transmitted from the in-vehicle communication apparatus, the pedestrian about approach of the vehicle in a way other than auditory stimulation if electric field strength at a time of receiving the vehicle travel data is larger than a first threshold; wherein in response to receiving the vehicle travel data wirelessly transmitted from the in-vehicle communication apparatus, the portable warning terminal warns the pedestrian about the approach of the vehicle in the way other than auditory stimulation if the electric field strength at the time of receiving the vehicle travel data is larger than the first threshold and if a rate of change in the electric field strength at the time of receiving the vehicle travel data is larger than a change rate threshold.

19. The vehicle approach warning system according to claim 18, wherein:

the vehicle travel data includes information about travel velocity of the vehicle; and the portable warning terminal alters a manner of warning about the approach of the vehicle in accordance with the travel velocity of the vehicle indicated in the received vehicle travel data.

20. The vehicle approach warning system according to a claim 18, wherein:

when the portable warning terminal warns the pedestrian about the approach of the vehicle, the portable warning terminal sends a reply to the in-vehicle communication apparatus;

when the in-vehicle communication apparatus receives the reply form the portable warning terminal, the in-vehicle communication apparatus gives a warning notification to a driver of the vehicle.

* * * * *